United States Patent [19]

Balbinot

[11] Patent Number: 4,697,359

[45] Date of Patent: Oct. 6, 1987

[54] FOOTWEAR STRUCTURE INCORPORATING A HEATING DEVICE PARTICULARLY FOR SKI BOOTS

[75] Inventor: Renzo Balbinot, Vittorio Veneto, Italy

[73] Assignee: Nordica S.p.A., Montebelluna TV, Italy

[21] Appl. No.: 861,287

[22] Filed: May 9, 1986

[30] Foreign Application Priority Data

Jun. 11, 1985 [IT] Italy ..... 22141/85[U]

[51] Int. Cl.[4] ..... A43B 7/02; A43B 5/04

[52] U.S. Cl. ..... 36/2.6; 36/117; 219/211

[58] Field of Search ..... 36/2.6, 117; 219/211, 219/527; 128/383

[56] References Cited

U.S. PATENT DOCUMENTS 3,859,496 1/1975 Giese ..... 36/2.6 X 4,455,764 6/1984 Rock et al. ..... 36/2.6

FOREIGN PATENT DOCUMENTS 146353 11/1903 Fed. Rep. of Germany ..... 219/211

3342276 6/1985 Fed. Rep. of Germany ..... 36/2.6

2365973 4/1978 France ..... 36/2.6

*Primary Examiner*—James Kee Chi

*Attorney, Agent, or Firm*—Guido Modiano; Albert Josif

[57] ABSTRACT

The footwear structure comprises a shell, including a sole portion and having a quarter connected thereto. The sole portion incorporates an electrical resistance heating circuit, electrically connected to terminals and at least one rechargeable storage battery. The structure further comprises a housing, positioned at a rear portion of the quarter, protruding rearwardly, and being adapted for removably receiving the rechargeable storage battery, and a switch for selectively electrically connecting the battery to the electrical resistance heating circuit.

5 Claims, 3 Drawing Figures

FOOTWEAR STRUCTURE INCORPORATING A HEATING DEVICE PARTICULARLY FOR SKI BOOTS

BACKGROUND OF THE INVENTION

The present invention relates to a footwear structure incorporating a heating device, particularly for ski boots.

An earlier patent by the same Assignee (U.S. Pat. No. 4,507,877) discloses a heating device, particularly for ski boots which comprises an inner ski boot, including a printed circuit electrical resistance heater and rechargeable storage batteries incorporated at a sole region thereof, and a plug, located at the upper portion of the inner ski boot which is adapted for connection to a source of electrical power for the purpose of re-charging the storage batteries.

Also known, for example from a further prior published patent application by the same Assignee (Italian Application No. 20890 B/83, filed on Feb. 22, 1983) is a heating device for ski boots which comprises a sock having a printed circuit electrical resistance heater at a sole portion thereof, a container, including rechargeable storage batteries and a plug, adapted for connection to a source of electrical power for re-charging the batteries.

The cited prior patent by the same Assignee (U.S. Pat. No. 4,507,877) also deals with a heating device for ski boots. This prior application primarily concerns the provision of a limiting device in an electrical resistance heating circuit, to prevent rechargeable storage batteries being over-charged, or completely exhausted, thereby rendering them unrechargeable. The device also comprises a socket for connecting a ski boot, to a source of electrical energy for recharging the storage batteries incorporated therein.

Furthermore, in another earlier published patent application by the same Assignee, (Italian Application No. 21947 B/84, filed on May 29, 1984) a ski boot is disclosed including an internal heating device which also incorporates a printed circuit electrical resistance heater and rechargeable storage batteries. The device further comprises a socket adapted for connection to a domestic power supply via a lead equipped with suitable plugs, for the purpose of recharging the batteries.

Such known ski boot structures however, are not exempt of drawbacks, which reside in the fact that such ski boots have to be taken proximately to a source of electrical energy, in order for the storage batteries incorporated therein to be recharged. Thus, after use, when the storage batteries need to be recharged, the ski boots, which frequently become soiled and wet must be taken indoors and connected to a source of electrical energy.

These prior arrangements, whilst being inconvenient, not least from the standpoint of cleanliness, incur a further serious disadvantage from the standpoint of safety, due to the fact that the ski boot, which may be wet, must be connected to a source of electrical energy and may therefore, inadvertently become a dangerous conductor of such energy.

Another inconvenience of these prior types, is that the ski boots cannot be used whilst the storage batteries are being recharged.

SUMMARY OF THE INVENTION

Accordingly, it is the task of this invention to provide a footwear structure incorporating a heating device particularly for ski boots wherein storage batteries, utilized as an energy source for the heating device, can be recharged without the compulsory requirement of placing the footwear structure proximate to a source of electrical energy.

Within the above purpose, it is an object of the invention to provide a footwear structure incorporating a heating device, particularly for ski boots, which is completely safe and reliable in use.

It is a further object of the invention, to provide a footwear structure incorporating a heating device, which is not compulsorily subject to inoperative periods whilst storage batteries are being recharged.

A not unimportant object of the invention, is to provide a footwear structure incorporating a heating device, which may be conveniently manufactured by utilization of readily available components and materials.

The above task and these and other objects which will become apparent hereinafter, are achieved by a footwear structure incorporating a heating device particularly for ski boots, comprising a shell including a sole portion and having a quarter connected thereto, said sole portion incorporating an electrical resistance heating circuit, electrically connected to terminals and at least one rechargeable storage battery, characterized in that it comprises housing means for receiving one rechargeable storage battery, in removable arrangement into said housing and means for electrically connecting said housing to said terminals.

BRIEF DESCRIPTION OF THE DRAWINGS

Further features and advantages of the invention will become apparent from the following description with reference to the illustrative, non limitative drawings where.

DESCRIPTION OF THE PREFERRED EMBODIMENTS

Figure 1:
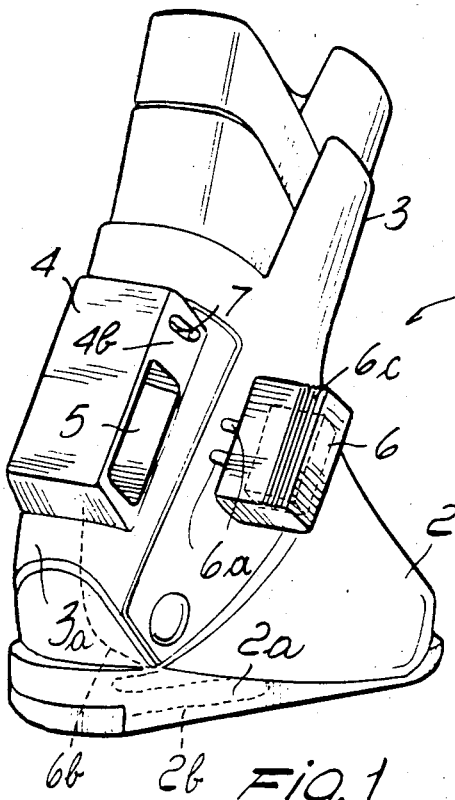
FIG. 1 is a perspective rear view of the footwear structure incorporating a heating device, according to the invention.

With reference to the above cited drawing figures, FIG. 1 shows a footwear structure which in the illustrated case is a ski boot, generally indicated by the reference numeral 1. The ski boot 1 includes a shell 2 having as a leg portion a front quarter 3 connected thereto and a rear quarter 3*a*. The shell 2 includes a sole portion 2*a*, which in a manner known per se and as such no further described or illustrated herein, incorporates an electrical resistance heater formed by a printed circuit, electrically connected to the terminals 4*a* (FIG. 2) of a casing 4.

The casing 4 has a housing or seat formation 5, formed therein, configured for removably accommodating at least one storage battery 6 as an electrical energy source means contained in a self contained receptacle member 6*c*, insertable in a manner such that the receptacle member closes the perimetral opening of the seat formation and that the terminals 6a of said at least one storage battery 6 will communicate with the terminals 4a of the casing 4, to form an electrical contact therebetween, and complete an electrical circuit between the battery 6 and the electrical resistance heater 2b, as an electrically powered heating means incorporated in said sole portion 2a. The receptacle 6c has surface portions 6e engaging with mating engagement surface portions 6d, provided in said heat formation 4.

Advantageously, it is envisaged that a circuit breaker device, actuable by displacement of a small lever or toggle switch 7 be provided to selectively cut-off the flow of electrical energy from the storage battery 6 to the electrical resistance heater, when operation of the heating device is not required. When the storage battery 6 is of the rechargeable type, circuitry 6b, known per se, may be included which is effective to automatically break the electrical circuit 6b, upon the electrical charge of the storage battery reaching a predetermined minimum level, wherebelow it would be rendered unrechargeable.

In the embodiment illustrated in FIG. 1, the casing 4 is positioned at the rear portion of the quarter 3 of the ski boot 1. The casing 4, of substantially parallelepipedal shape, protrudes unobtrusively rearwardly with respect to rear edge 3a (FIG. 3) of the quarter 3, and has a housing 5 formed therein which is open outwardly at a lateral face 4b of the casing 4. The toggle switch 7 for actuating the circuit breaker device is located above the housing 5, and proximate thereto, on the lateral face 4b of the casing 4.

With reference now to the drawing FIG. 2, the embodiment illustrated therein is substantially similar to the embodiment of FIG. 1, described hereinabove, but in this case, the casing 4 is located at the front portion of the ski boot 1 quarter 3; the housing 5, being open upwardly, and the toggle switch 7 being positioned at a side portion of the quarter 3.

Figure 2:
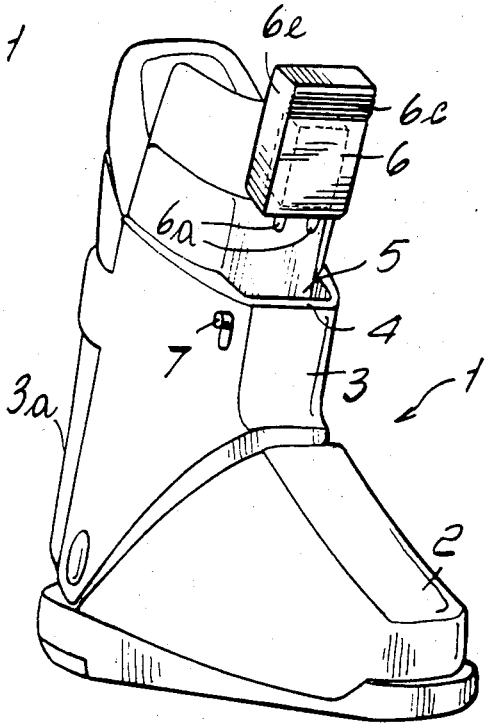
FIG. 2 is a perspective view of a footwear structure incorporating a heating device, according to another embodiment of the invention.

In the illustrated embodiments of both FIGS. 1 and 2, the storage battery 6 is of the rechargeable type. The battery 6 is adapted to be removably inserted into the housing 5 and electrically connectable to the terminals 4a provided in the casing 4. When fully inserted into the housing 5, a ribbed portion 6a of the battery 6 protrudes beyond the casing 4 such that it may be easily gripped to facilitate removal of the battery 6 from the housing 5.

Figure 3:
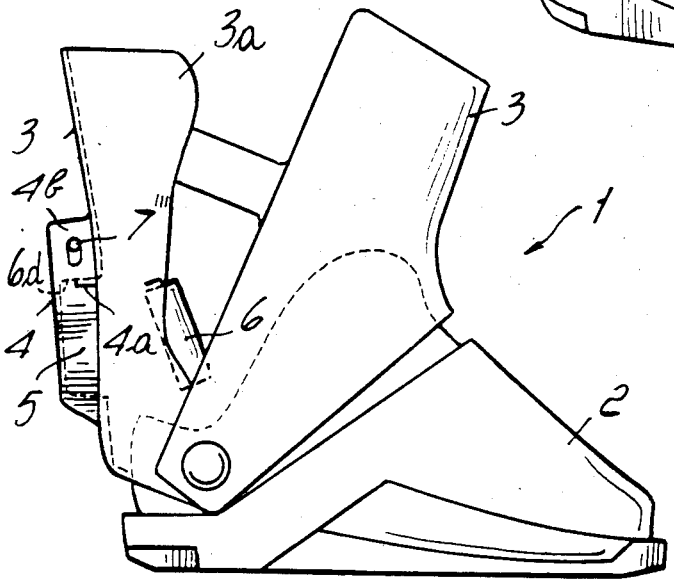
FIG. 3 is a side elevation view of the footwear structure incorporating a heating device according to a further embodiment of the invention.

The ski boot 1 structure illustrated in drawing FIG. 3, includes a casing 4 formed at a rear portion of the quarter 3. In this embodiment, the housing 5 is open towards the interior of the ski boot 1, thereby defining a recess at the interior rear portion of the quarter 3, whereinto the storage battery 6, which in this instance is of the ordinary, non-rechargeable type, is insertable. The casing 4, is substantially completely sealed externally by virtue of the fact that the housing 5 is open towards the interior of the ski boot, the toggle switch 7, for actuation of the cited circuit breaker device being provided at a lateral face 4b of the casing 4.

The operation of the footwear structure according to the invention is evident from the foregoing description. In order to actuate the heating device incorporated in the structure, it will be sufficient to merely insert the storage battery, and translate the toggle switch to deactivate the circuit breaker device, thereby completing the electrical circuit between the storage battery ant the cited heating device.

In the case of rechargeable batteries being used with the inventive structure, when such batteries need to be recharged, it will be sufficient to simply grip the ribbed area of the battery protruding beyond the casing, and exert a pulling force to extract the battery, which may then be recharged at any convenient location, remote from and independently of the footwear structure itself.

Thus, as may be appreciated from the foregoing description, in a footwear structure incorporating a heating device according to the invention, storage batteries can be easily inserted into and extracted from the housing provided on such structure without the need of any special tools or time consuming operations.

Such an arrangement is especially advantageous when rechargeable batteries are used. Removal of the storage battery for recharging purposes not only obviates the inconvenience of compulsorily, placing a soiled, wet item of footwear indoors and incurring the potential risk of placing it in communication with a supply of electricity, but also permits one storage battery to be used whilst another battery is being recharged, thereby permittng the footwear to be available for use in a fully operative condition at all times.

This facility is also advantageous, from the point of view that spare, fully charged batteries may be carried by the user of the footwear, so that in the event of the energy stored in one battery being consumed, the exhausted battery may be quickly removed and replaced with the spare, fully charged battery.

A further advantage of the invention, resides in the fact that the inventive structural arrangement permits ordinary batteries to be used instead of the more expensive types of storage batteries comprising nickel-cadmium cells.

The invention disclosed herein is susceptible to many modifications and variations without departing from the inventive concept.

Furthermore, all of the details may be replaced with any other technically equivalent elements.

In practicing the invention any materials, dimensions and contingent shapes may be used according to individual requirements.

I claim:

1. A footwear structure including a composite heating device particularly for ski boots, the footwear structure comprising a shell, leg portions and sole defining portions, an open seat formation in one of said leg portions, said seat formation having an opening at a perimeter surface thereof and mating internal surface portions, the composite heating device comprising electrically powered heating means at least in part arranged in said sole defining portions and electrical energy source means received in said seat formation and circuit means electrically connecting said electrical energy source means and said electrically powered heating means, wherein said composite heating device further comprises a self contained removable receptacle member enclosing therein said elctrical energy source means and having outwardy exposed electrical terminal means and mating perimetral surface portions for removable mating engagement with said mating internal surface portions provided in said seat formation and closing said opening thereof, said seat formation having mating electric terminal means contained therein and removably connectable with said outwardly exposed electric terminal means, said mating terminal means being a component part of said circuit means electrically connecting said electrical energy source means and said electrically powered heating means.

2. A footwear structure according to claim 1, wherein said leg portions comprises a rear quarter and wherein said seat formation is in the form of a housing formation integral with said rear quarter and is formed on the rear surface thereof substantially like a hollow prallelepiped body portion having a lateral outside opening for the insertion therein of said self contained receptacle member.

3. A footwear structure according to claim 1, wherein said leg portions further comprise a front quarter connected to said shell and wherein said seat formation is integral with said front quarter and is formed on the front surface thereof substantially like a hollow parllelpiped body portion having an outside opening at the top thereof for the insertion therein of said self contained receptacle member.

4. A footwear structure according to claim 1, wherein said seat formation is in the form of a recess provided on the inner surface of said rear quarter, an open side of said recess facing inwardly for inserting therein from the inside said self contained receptacle member.

5. A footwear structure according to claim 1, wherein said circuit means include a switch having an actuation member thereof projection from an outside surface of said reseptacle member.

* * * * *